United States Patent [19]

Copeland

[11] Patent Number: 4,725,376

[45] Date of Patent: Feb. 16, 1988

[54] METHOD OF MAKING SOLID CAST ALKALINE DETERGENT COMPOSITION

[75] Inventor: James Copeland, Burnsville, Minn.

[73] Assignee: Ecolab Inc., St. Paul, Minn.

[21] Appl. No.: 855,111

[22] Filed: Apr. 23, 1986

[51] Int. Cl.[4] ..... C11D 11/00; C11D 7/16

[52] U.S. Cl. ..... 252/90; 252/135; 252/174

[58] Field of Search ..... 252/90, 92, 99, 135, 252/174, DIG. 16

[56] References Cited

U.S. PATENT DOCUMENTS

| | | | |
|---|---|---|---|
| 2,164,092 | 6/1939 | Smith | 23/107 |
| 2,382,163 | 8/1945 | MacMahon | 252/138 |
| 2,382,164 | 8/1945 | MacMahon | 252/138 |
| 2,382,165 | 8/1945 | MacMahon | 252/135 |
| 2,412,819 | 12/1946 | MacMahon | 252/138 |
| 2,920,417 | 1/1960 | Wertheimer | 252/92 |
| 2,987,483 | 6/1961 | Brooker | 252/138 |
| 3,318,817 | 5/1967 | Cunningham | 252/174 |
| 3,366,570 | 1/1968 | Slob | 252/99 |
| 4,569,781 | 2/1986 | Fernholz et al. | 252/92 |
| 4,588,080 | 5/1986 | Ginn | 206/219 |
| 4,595,520 | 6/1986 | Heile et al. | 252/160 |

FOREIGN PATENT DOCUMENTS 0003769 9/1982 European Pat. Off. .

*Primary Examiner*—Prince E. Willis

*Attorney, Agent, or Firm*—Merchant, Gould, Smith, Edell, Welter & Schmidt

[57] ABSTRACT

A method of manufacturing a solid cast detergent composition comprising the steps of introducing a solid particulate detergent-component into a mold wherein the particulate defines an interstitial void volume; introducing into the mold, in the absence of substantial agitation, an effective interstitial void volume occupying amount of an aqueous solution of a hydratable alkaline chemical; allowing the aqueous solution to percolate the detergent-component particles; and solidifying the aqueous solution. The preferred detergent-component is a condensed phosphate and the preferred alkaline-chemical is sodium hydroxide.

12 Claims, 1 Drawing Figure

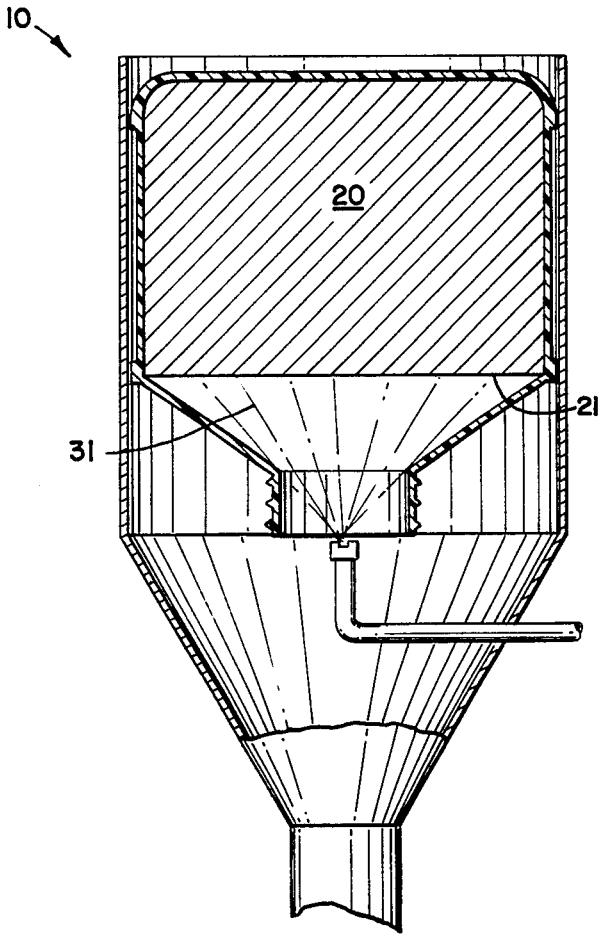
10
20
21
31

METHOD OF MAKING SOLID CAST ALKALINE DETERGENT COMPOSITION

FIELD OF THE INVENTION

The invention relates to cast detergent compositions. Most specifically, the invention relates to the manufacture of solid cast alkaline detergent compositions using separate liquid and solid components.

BACKGROUND OF THE INVENTION

Automated institutional and industrial ware-washing machines are generally configured with a single wash tank for maintaining a readily available supply of a cleaning solution for use in the machine. During normal usage at least a portion of the cleaning solution is periodically discarded in order to keep the remaining cleaning solution as clean as possible. Fresh water or clean recycled water is than added to the wash tank to maintain an appropriate liquid level. Addition of the fresh water dilutes the concentration of detergent in the cleaning solution. To maintain the cleaning solution at the most efficient detergent concentration, a measured amount of a concentrated detergent solution is periodically added to the wash tank by an auxiliary detergent dispenser to form a cleaning solution of the desired strength.

The above referenced detergent dispensers are typically designed to automatic or semi-automatic operation. Automatic dispensers are preferred becuase they (i) eliminate the need for constant operator attention, (ii) minimize operator error due to misjudgment in timing or amount of cleaning composition to be added, and (iii) provide greater accuracy in maintaining the optimum concentration of cleaning composition in the wash tank.

One such automatic dispenser is designed to dispense a solid cast detergent by spraying water onto an exposed surface of the solid block of detergent to form a concentrated detergent solution which is directed to the wash tank of the washing machine. Such dispensers are disclosed in commonly owned U.S. Pat. Nos. 4,426,362, 4,569,780, and 4,569,781, and commonly owned copending U.S. application Ser. Nos. 796,017, 817,399 and 817,750.

Utilization of such auxiliary detergent dispensers requires the availability of a solid cast dissolvable detergent. Two methods of manufacturing such detergent blocks are disclosed in commonly owned U.S. Pat. Nos. 4,569,780 and 4,569,781 issued to Fernholz et al, and commonly owned U.S. patent application Ser. No. 663,473 now U.S. Pat. No. 4,595,520. Fernholz discloses a method for the casting of a homogeneous solid detergent composition comprising the steps of (i) heating a 40–75 wt-% aqueous solution of an alkali metal hydroxide, (ii) distributing about 15 to 40 parts by weight of an alkaline hydratable chemical into the solution to form a homogeneous mixture, (iii) pouring the homogeneous mixture into a receptacle, and (iv) allowing the mixture to solidify and form a homogeneous, solid cast detergent composition. Ser. No. 664,473 discloses a method for the casting of a homogeneous solid deterent composition comprising the steps of (i) forming an aqueous emulsion of an alkaline compound, a hardness sequestering condensed phosphate, a hectorite clay and a hydratable solidifying agent, (ii) heating the emulsion to a temperature sufficient to hydrate the solidifying agent, and (iii) cooling the emulsion to form a homogeneous, solid cast detergent composition.

While solid cast detergent compositions formed in accordance with Fernholz and Heile represent a substantial improvement over prior detergent compositions, the search for new and improved casting methods continues.

As a result of this search, I have discovered a novel method of forming a solid cast detergent composition.

BRIEF DESCRIPTION OF THE DRAWING

FIG. 1 is a front cross-sectional view of one means for dispensing the detergent composition of the present invention.

SUMMARY OF THE INVENTION

I have found that solid cast can be formed by adding a hydratable chemical solution into a receptacle containing a particulate solid phase having a particle size that permits percolation of the solid phase by the solution. This allows the use of a heated solution in conjunction with an unheated particulate phase which reduces heat requirements and reduces the heat history of the solid. Broadly, the method comprises the steps of (i) introducing a solid particulate detergent-component into a mold; the solid particles defining an interstitial void volume such that the ratio of particle volume to interstitial void volume is between about 7:3 to about 3:7; (ii) introducing into the mold, in the absence of substantial agitation, an effective interstitial void volume occupying amount of an aqueous solution of a hydratable alkaline chemical heated to an effective viscosity modifying temperature sufficient to allow the solution to percolate the particles and occupy substantially all of the interstitial void volume, thereby forming an insterstitial liquid phase; and (iii) solidifying the interstitial liquid phase to form the solid cast detergent.

The detergent composition may further comprise effective amounts of commonly employed detergent components. These additional components may be incorporated into the detergent composition in the appropriate phase (i.e. the solid or aqueous phase).

As used herein, "detergent-component" refers to those compounds commonly employed in conjunction with an alkaline compound to form a detergent with the desired cleansing efficiency. A nonexhaustive list of "detergent-components" includes water conditioning agents such as condensed phosphates and organic chelates; fillers such as sodium chloride and sodium sulfate; chlorine sources such as sodium trichloroisocyanurate and sodium chlorite.

As used herein, "percolate" means to pass or ooze through or around.

As used herein, "substantial agitation" means to move or stir to such a degree as to dissipate substantial portions of each particle throughout the liquid portion.

DETAILED DESCRIPTION OF THE INVENTION INLUDING A BEST MODE

The process of the present invention allows incompatible detergent components to be efficiently and economically combined into a solid cast detergent composition with a minimum amount of heating.

Broadly, the process combines incompatible detergent components by incorporating the components in different phases with minimal agitation. The first or aqueous phase utilized in the process should be capable of solidifying above about 45° C. to form a solid cast when combined with the second or solid particulate phase. The cast should not liquefy when subjected to temperatures normally encountered during transport and storage of the composition. Interaction between the two phases is reduced by (i) placing the solid particulate phase in a mold creating a particulate volume and an interstitial void volume, (ii) introducing heated aqueous solution into the particle filled mold, (iii) allowing the aqueous solution to percolate the particles without agitation and fill the interstitial void volume to create the detergent composition, and (iv) solidifying the detergent composition.

Detergent compositions preferably contain at least (i) a highly alkaline component and (ii) a hardness sequestrant. A list of hydratable alkaline chemicals commonly utilized in detergent compositions which may be utilized in the method of the present invention includes but is not limited to alkali metal bases including sodium and potassium phosphate, potassium borate, sodium carbonate, sodium metasilicate, sodium orthosilicate, sodium hydroxide, and appropriate hydrates thereof. However, we have discovered that silicate solutions have difficulty completely percolating the solid particles. For reasons of low cost and high alkalinity the preferred alkaline chemical is an alkali hydroxide.

A list of hardness sequestrants commonly utilized in detergent compositions and useful in the practice of the present invention includes but is not limited to alkali metal phosphates and condensed phosphates including tri-sodium and potassium phosphate, tetrasodium and potassium pyrophosphate, pentasodium triphosphate, sodium tripolyphosphate, glassy phosphates, potassium phosphates, and mixtures thereof. For reasons of low cost and effective sequestering ability the preferred sequestrant is sodium tripolyphosphate.

The detergent composition formed in accordance with the method of this invention preferably contains about 70 to 30 vol-% alkaline solution and about 30 to 70 vol-% of a detergent-component. Preferably, the detergent composition contains about 60 to 40 vol-% alkaline solution, and about 40 to 60 vol-% of a detergent-component. Most preferably, the detergent composition comprises about 55 to 45 vol-% alkaline solution, and about 45 to 55 vol-% of a detergent component.

The preferred detergent-components are polyelectrolyte water conditioners. More preferred detergent-components are condensed phosphate hardness sequestrants. The most preferred detergent-component is sodium tripolyphosphate.

When the preferred alkaline chemical is utilized (sodium hydroxide), the alkaline solution preferably contains about 60 to 80 wt-% sodium hydroxide; most preferably about 65 to 75 wt-% sodium hydroxide. When employing less alkaline chemicals a higher wt-% may be necessary to achieve the desired cleansing effect.

Because the detergent composition is preferably substantially homogeneous along its vertical axis the preferred mode for achieving the desired ratio of components is to regulate the size and shape of the solid particles. Altering the size and/or shape of the particles proportionally alters the ratio between solid particle volume and interstitial void volume, thereby correspondingly altering the relative proportions of the components. However, the ability to alter the relative proportions of the components in this manner is limited as particle size must be large enough to allow the alkaline solution to completely percolate all the particles within a reasonable time period yet small enough to maintain a substantially constant component proporitionality in the concentrated detergent solution when dispensed from a spray-type dispenser. Therefore, the particle sizes should be between about 4 to 100 U.S. mesh, and preferably between 10 to 20 U.S. mesh. A second, less preferred means of controlling the component proportionality is to incorporate a filler into the detergent composition. This is less preferred because of the increased expense and descrease active component percentage. When utilized, the filler is preferably chosen from those filler commonly employed in detergent compositions which include but are not limited to sodium chloride, sodium sulfate, sodium borate, etc. A third less preferred means is to incorporate alkaline chemical into the solid particles. This third method is less preferred because of the expense of dry sodium hydroxide.

The ability of the alkaline solution to percolate the particles and occupy the interstitial void volume is dependent upon several variables including the alkaline chemical used (preferably sodium hydroxide), particle size (preferably 10 to 20 U.S. mesh), particle shape (preferably substantially spherical), viscosity of the alkaline solution (preferably below about 100 cp), temperature dependency of the viscosity of the alkaline solution, and temperature of the particles (preferably room temperature); any of which may be altered to ensure that the alkaline solution fills substantially all of the interstitial void volume.

Preferably, these variables are adjusted so that the alkaline solution can completely percolate the particles between about 0.1 to 2 minutes, and perferably between about 0.25 to 1 minute.

The solid block of detergent composition should have a substantially homogeneous distribution of the solid particles to ensure that the components are dispensed in the appropriate proportions when dissolved by a solvent spray. Therefore, when the particulate and aqueous phases are combined, it is important that the aqueous phase percolate the particles and occupy substantially all of the interstitial void volume to prevent a top layer comprising 100% aqueous phase components and pockets comprising 100% solid particle phase components from forming. In addition, it is important that sufficient aqueous phase be added to the particles to occupy substantially all of the interstitial void volume without excess to prevent either a top layer comprising 100% aqueous phase components or a top layer comprising 100% solid particles from forming.

When the alkaline solution is added to the receptacle the volume occupied by the particles and the alkaline solution will initially be about twice what the final solid cast detergent composition will occupy because the alkaline solution will be resting on top of the solid particles. Therfore, it is necessary that the receptacle be able to temporarily hold about twice the volume of the final solid cast detergent composition until the alkaline solution percolates the particles (i.e. about 10 to 20 minutes).

A nonexhaustive list of methods which may be employed to accomodate this excess volume include: (i) incorporating a removable upper receptacle portion which, upon complete percolation, may be removed from the receptacle and recycled; (ii) utilizing a separate mold for percolation from which the substantially solidified cast detergent composition is removed for placement in a smaller container for shipping, storage and sale; (iii) utilizing a sufficiently large container for both percolation and sale which will simply have an unfilled volume when sold; (iv) utilizing a reusable, temporary top for retaining the excess alkaline solution while it percolates through the particles; (v) allowing the alkaline solution to percolate the particles in a temporary mold sized and shaped such that the percolated molten or solid detergent composition can be simply slid out of the mold and into a receptacle for shipping, storage and sale; and (vi) adding the alkaline solution slowly enough so that the alkaline solution percolates substantially as quickly as it is added. To reduce percolation time, pressure may be applied above the added alkaline solution.

Solidification of the cast composition may be done in any convenient manner such as allowing it to cool under room conditions, quenching it in a cooling tank or placing it in a refrigerated unit.

Either during or after solidification a cover or cap can be placed over the access port to the receptacle to seal the cast detergent composition until used.

The detergent composition may be cast into a temporary mold from which it is subsequently transferred for packaging in a separate receptacle, or may be cast directly into the receptacle used for shipping and sale. Preferably, the composition is cast directly into the final container in order to eliminate the transfer step.

The receptacle may be made of any material capable of housing the detergent composition, including but not limited to glass; metals such as aluminum and steel; and structural resins such as polyolefins (polyethylene), polyesters (mylar), polyamide (nylon), etc. When the detergent composition is cast directly into the receptacle, the receptacle must be capable of withstanding temperatures encountered during the casting process. For reasons of cost, the preferred material is a polyolefin with polyprophlene being the most preferred.

As shown in FIG. 1, a preferred means of dispensing the detergent composition is from a spray type dispenser which comprises impinging a water spray 31 upon an exposed surface(s) 21 of the solid block detergent composition 20, thereby dissolving a portion of the detergent composition 20 and forming a concentrated detergent solution which is allowed to pass out of the dispenser 10.

The most preferred means of dispensing the detergent composition is disclosed in co-pending U.S. patent application Ser. No. 817,399 wherein (i) the composition is cast directly into a right angle cylindrical container from which the composition is dispensed, (ii) an exposed surface of the composition is placed upon and supportably engaged by a right angle cylindrical screen, and (iii) water is sprayed onto the exposed surface of the composition, dissolving the composition and forming a concentrated solution. Such a dispenser allows the composition to be dispensed without removing it from the container and dispenses a concentrated solution of substantially constant concentration over the lifetime of the block of detergent as it maintains a relatively constant distance between the dissolving exposed surface of the composition and the spray nozzle.

For dispensing from the preferred dispenser, the container must leave at least one surface of the detergent composition exposed, preferably leaving only a single exposed surface, so that water may be impinged upon the detergent composition.

The detergent composition may be cast into any suitable size and shape but, for reasons of (i) shortening the time period necessary to complete percolation and solidification of the composition, (ii) presenting an exposed surface large enough to allow dispensing at an effective rate, and (iii) ease of shipping and handling, the preferred size of the detergent composition receptacle is between about 3 to 10 liters with an exposed surface area of about 50 to 500 square centimeters, and most preferably between about 3 to 4 liters with an exposed surface area of about 150 to 200 square centimeters.

The detergent composition must be dissolved or otherwise dispersed in wash water to impart its cleaning property onto the substrate to be cleaned. Therefore, the formulation and means of dispensing must be capable of delivering detergent compostion into the wash water at a reasonable rate. The detergent composition may be dissolved prior to use to assure a ready supply of the detergent composition but such a system destroys many of the advantages offered by casting the composition. To satisfy the vast majority of institutional and commercial cleansing machines, the composition should be capable of readily dissolving directly from the solid form at a rate of about 10 to 50 grams of active components (caustic and sequestering agents) per minute, most preferably about 15 to 35 grams of active components per minute. The rate of dissolution depends upon several variables which include but are not limited to (i) formulation of the composition, (ii) method of dispensing employed, (iii) shape of the cast composition, and (iv) temperature of the solvent; all of which may be adjusted to reach the desired dispensing rate and compensate for changes in the other variables.

EXAMPLE I

Into a 3.5 liter receptacle was placed 2,000 grams (50 wt-% of the detergent composition) of 20 to 100 U.S. mesh particles; 50 wt-% of the particles comprising 20–40 U.S. mesh tripolyphosphate particles and 50 wt-% of the particles comprising 20–100 U.S. mesh hydrated sodium disilicate particles. 2,000 grams (50 wt-% of the detergent composition) of an aqueous 70 wt-% sodium hydroxide solution was heated to 180° F. and poured into the receptacle without substantial agitation to form the detergent composition. The aqueous solution completely percolated the particles in 2 minutes. The detergent composition solidified in 15 minutes. 62.3 wt-% of the tripolyphosphate incorporated in the detergent composition was present in the solidified detergent composition in unreverted form.

EXAMPLE II

A solid block detergent composition was formed in accordance with the procedure of Example I except that the sodium hydroxide solution was heated to 170° F. 64.0 wt-% of the tripolyphosphate incorporated in the detergent composition was present in the solid detergent composition in unreverted form.

EXAMPLE III

A solid block detergent composition was formed in accordance with the procedure of Example I except that the sodium hydroxide solution was heated to 160° F. 60.3 wt-% of the tripolyphosphate incorporated in the detergent composition was present in the solidified detergent composition in unreverted form.

EXAMPLE IV

Into a 3.5 liter receptacle was placed 2,400 grams (60 wt-% of the detergent composition) of 20 to 100 U.S. mesh particles; 42 wt-% of the particles comprising 20–40 U.S. mesh tripolyphosphate particles, 42 wt-% of the particles comprising 20–100 US. mesh hydrated sodium disilicate particles, and 16 wt-% of the particles comprising 12 to 100 U.S. mesh beaded sodium hydroxide particles. 1,600 grams (40 wt-% of the detergent composition) of a 62.5 wt-% sodium hydroxide solution was heated to 180° F. and poured into the receptacle without substantial agitation to form the detergent composition. The aqueous solution completely percolated the particles in 2 minutes. The detergent composition solidified in 15 minutes. 53.3 wt-% o the tripolyphosphate incorporated in the detergent composition was present in the solidified detergent composition in unreverted form.

EXAMPLE V

A solid block detergent composition was formed in accordance with the procedure of Example IV except that the sodium hydroxide solution was heated to 170° F. 55.6 wt-% of the tripolyphosphate incorporated in the detergent composition was present in the solidified detergent composition in unreverted form.

EXAMPLE VI

A solid block detergent composition was formed in accordance with the procedure of Example IV except that the sodium hydroxide solution was heated to 160° F. 65.3 wt-% of the tripolyphosphate incorporated in the detergent composition was present in the solidified detergent composition in unreverted form.

EXAMPLE VII

Into a 3.5 liter receptacle was placed 2,700 grams (67.5 wt-% of the detergent composition) of 20 to 100 U.S. mesh particles; 42 wt-% of the particles comprising 20–40 U.S. mesh tripolyphosphate particles, 37 wt-% of the particles comprising 20–100 U.S. mesh hydrated sodium disilciate particles, and 26 wt-% of the particles comprising 12 to 100 U.S. mesh beaded sodium hydroxide particles. 1,300 grams (32.5 wt-% of the detergent composition) of a 53.8 wt-% sodium hydroxide solution was heated to 180° F. and poured into the receptacle without substantial agitation to form the detergent composition. The aqueous solution completely percolated the particles in 2 minutes. The detergent composition solidified in 15 minutes. 62.5 wt-% of the tripolyphosphate incorporated in the detergent composition was present in the solidified detergent composition in unreverted form.

EXAMPLE VIII

A solid block detergent composition was formed in accordance with the procedure of Example VII except that the sodium hydroxide solution was heated to 170° F. 64.0 wt-% of the tripolyphosphate incorporated in the detergent composition was present in the solidified detergent composition in unreverted form.

EXAMPLE IX

A solid block detergent composition was formed in accordance with the procedure of Example VII except that the sodium hydroxide solution was heated to 160° F. 65.2 wt-% of the tripolyphosphate incorporated in the detergent composition was present in the solidified detergent composition in unreverted form.

EXAMPLE X

A solid block detergent composition was formed in accordance with the procedure of Example I except that the 20–40 U.S. mesh tripolyphosphate was replaced with 8 to 20 U.S. mesh tripolyphosphate. 62.3 wt-% of the FMC tripolyphosphate incorporated in the detergent composition was present in the solidified detergent composition in unreverted form.

EXAMPLE XI

A solid block detergent composition was formed in accordance with the procedure of Example II except that the 20–40 U.S. mesh tripolyphosphate was replaced with 8 to 20 U.S. mesh polyphosphate. 65.4 wt-% of the FMC tripolyphosphate incorporated in the detergent composition was present in the solidified detergent composition in unreverted form.

EXAMPLE XII

A solid block detergent composition was formed in accordance with the procedure of Example III except that the 20–40 U.S. mesh tripolyphosphate was replaced with 8 to 20 U.S. mesh tripolyphosphate. 68.1 wt-% of the FMC tripolyphosphate incorporated in the detergent composition was present in the solidified detergent composition in unreverted form.

EXAMPLE XIII

A solid block detergent composition was formed in accordance with the procedure of Example I except that the tripolyphosphate was replaced with hydrated phosphate. 80.3 wt-% of the hydrated phosphate incorporated in the detergent composition was present in the solidified detergent composition in unreverted form.

EXAMPLE XIV

A solid block detergent composition was formed in accordance with the procedure of Example II except that the tripolyphosphate was replaced with hydrated phosphate. 84.5 wt-% of the hydrated phosphate incorporated in the detergent composition was present in the solidified detergent composition in unreverted form.

EXAMPLE XV

A solid block detergent composition was formed in accordance with the procedure of Example III except that the tripolyphosphate was replaced with hydrated phosphate. 86.7 wt-% of the hydrated phosphate incorporated in the detergent composition was present in the solidified detergent composition in unreverted form.

EXAMPLE XVI

Into a 3.5 liter receptacle was placed 2,219 grams (55.5 wt-% of the detergent composition) of 20 to 100 U.S. mesh particles; 50 wt-% of the particles comprising 20–40 U.S. mesh hydrated tripolyphosphate particles, and 45 wt-% of the particles comprising 20–100 U.S. mesh hydrated sodium disilicate particles. 1,781 grams (44.5 wt-% of the detergent composition) of a 78 wt-% sodium hydroxide solution was heated to 190° F. and added to the receptacle without substantial agitation to form the detergent composition. The aqueous solution completely percolated the particles in 2 minutes. The detergent composition solidified in 15 minutes. 91.5 wt-% of the hydrated tripolyphosphate incorporated in the detergent composition was present in the solidified detergent composition in unreverted form.

EXAMPLE XVII

A solid block detergent composition was formed in accordance with the procedure of Example XVI except that the sodium hydroxide solution was heated to 180° F. 94.0 wt-% of the hydrated tripolyphosphate incorporated in the detergent composition was present in the solidified detergent composition in unreverted form.

EXAMPLE XVIII

A solid block detergent composition was formed in accordance with the procedure of Example XVI except that the sodium hydroxide solution was heated to 170° F. 95.0 wt-% of the hydrated tripolyphosphate incorporated in the detergent composition was present in the solidified detergent composition in unreverted form.

EXAMPLE XIX

Into a 3.5 liter receptacle was placed 2,220 grams (55.5 wt-% of the detergent composition) of 20 to 100 U.S. mesh particles; 42 wt-% of the particles comprising 20–40 U.S. mesh tripolyphosphate particles, 45 wt-% of the particles comprising 20–100 U.S. mesh hydrated sodium disilicate particles, and 10 wt-% of the particles comprising 20 to 100 U.S. mesh sodium chloride. 1,780 grams (about 44.5 wt-% of the detergent composition) of a 73 wt-% sodium hydroxide solution was heated to 190° F. and added to the receptacle without substantial agitation to form the detergent composition. The aqueous solution completely percolated the particles in 2 minutes. The detergent composition solidified in 15 minutes. 79.5 wt-% of the tripolyphosphate incorporated in the detergent composition was present in the solidified detergent composition in unreverted form.

EXAMPLE XX

A solid block detergent composition was formed in accordance with the procedure of Example XIX except that the sodium hydroxide solution was heated to 180° F. 81 wt-% of the tripolyphosphate incorporated in the detergent composition was present in the solidifed detergent composition in unreverted form.

EXAMPLE XXI

A solid block detergent composition was formed in accordance with the procedure of Example XIX except that the sodium hydroxide solution was heated to 170° F. 82.5 wt-% of the tripolyphosphate incorporated in the detergent composition was present in the solidified detergent composition in unreverted form.

EXAMPLE XXII

A solid block detergent composition was formed in accordance with the procedure of Example XIX except that the 20–40 U.S. mesh tripolyphosphate was replaced with 8 to 20 U.S. mesh tripolyphosphate. 78.5 wt-% of the tripolyphosphate incorporated in the detergent composition was present in the solidified detergent composition in unreverted form.

EXAMPLE XXIII

A solid block detergent composition was formed in accordance with the procedure of Example XX except that the 20–40 U.S. mesh tripolyphosphate was replaced with 8 to 20 U.S. mesh tripolyphosphate. 79.5 wt-% of the tripolyphosphate incorporated in the detergent composition was present in the solidified detergent composition in unreverted form.

EXAMPLE XXIV

A solid block of detergent composition was formed in accordance with the procedure of Example XXI except that the 20–40 U.S. mesh tripolyphosphate was replaced with 8 to 20 U.S. mesh tripolyphosphate. 81.5 wt-% of the tripolyphosphate incorporated in the detergent composition was present in the solidified detergent composition in unreverted form.

I claim:

1. A method of manufacturing a solid cast detergent composition comprising the steps of:

(a) introducing a solid particulate, inorganic, detergent component into a mold wherein the particulate is characterized by an interstitial void volume of about 30 to 70% and a particle size of about 4 to 100 U.S. mesh;

(b) introducing, in the absence of substantial agitation, an aqueous solution of a hydratable alkaline chemical heated to a temperature resulting in a viscosity that permits the aqueous solution to percolate the particulate and substantially occupy the interstitial void volume to form a liquid interstitial phase, the hydratable alkaline chemical selected from the group consisting of alkali metal phosphates alkali metal borates, alkali metal corbonates, alkali metal metasilicates, alkali metal orthosilicates and alkali metal hydroxides and comprising a component which is different than the inorganic detergent component such that the detergent composition comprises a combination of at least two different components; and (c) solidifying the liquid interstitial phase to form a solid cast detergent

2. The method of claim 1 wherein the alkaline solution further comprises an additive selected from the group consisting of sodium chloride, sodium sulfate and sodium borate.

3. The method of claim 1 wherein the particulate is characterized by an interstitial void volume of about 40 to 60%.

4. The method of claim 1 wherein the particulate is characterized by an interstitial void volume of about 45 to 55%.

5. The method of claim 1 wherein the particles are about 10 to 20 U.S. mesh.

6. The method of claim 1 wherein the inoraganic detergent component comprises a condensed phosphate hardness sequestering agent.

7. The method of claim 6 wherein the condensed phosphate comprises sodium tripolyphosphate.

8. The method of claim 1 wherein the aqueous solution of a hydratable alkaline chemical comprises about a 60 to 80 wt-% solution of sodium hydroxide, based upon the aqueous solution.

9. The method of claim 8 wherein the aqueous solution of a hydratable alkaline chemical comprises about a 65 to 75 wt-% solution of sodium hydroxide, based upon the aqueous solution.

10. The method of claim 8 wherein the detergent composition comprises about 40 to 60 volume-% inorganic detergent component and about 60 to 40 volume-% aqueous sodium hydroxide.

11. The method of claim 9 wherein the detergent composition comprises about 45 to 55 volume-% inorganic detergent component and about 55 to 45 volume-% aqueous sodium hydroxide.

12. A method of manufacturing a substantially homogeneous, solid cast detergent composition resulting in minimal reversion of active ingredients, comprising the steps of:

(a) introducing a plurality of solid condensed phosphate hardness sequestering agent particles into a 3 to 4 liter receptacle, the receptacle comprising a plastic selected from the group consisting of polyethylene, polypropylene and polyvinylchloride, the solid particles defining a 45 to 55 volume-% interstitial void volume and a 55 to 45 volume-% particle volume;

(b) heating a 65 to 75 wt-% aqueous solution of sodium hydroxide based upon the aqueous solution to about 150° to 170° F.;

(c) introducing about 55 to 45 volume-% based on the detergent composition aqueous solution into the receptacle in the absence of substantial agitation;

(d) allowing the aqueous solution to percolate the plurality of solid particles and occupy substantially all of the interstitial void volume to form the detergent composition; and (e) allowing the detergent composition to solidify.

* * * * *